US009510984B1

(12) United States Patent
MacKenzie

(10) Patent No.: US 9,510,984 B1
(45) Date of Patent: Dec. 6, 2016

(54) WHEELCHAIR WITH TOILET SEAT

(71) Applicant: Bruce A. MacKenzie, Splendora, TX (US)

(72) Inventor: Bruce A. MacKenzie, Splendora, TX (US)

( * ) Notice: Subject to any disclaimer, the term of this patent is extended or adjusted under 35 U.S.C. 154(b) by 0 days.

(21) Appl. No.: 14/513,829

(22) Filed: Oct. 14, 2014

Related U.S. Application Data

(63) Continuation-in-part of application No. 14/034,800, filed on Sep. 24, 2013, now abandoned.

(51) Int. Cl.
*A47K 11/06* (2006.01)
*A61G 5/10* (2006.01)
*A47K 13/00* (2006.01)

(52) U.S. Cl.
CPC ..... *A61G 5/1002* (2013.01); *A47K 13/00* (2013.01)

(58) Field of Classification Search
CPC ..... A47K 13/00; A61G 5/1002; A61G 7/02; A61G 9/003
USPC ..... 4/480, 450
See application file for complete search history.

(56) References Cited

U.S. PATENT DOCUMENTS 421,467 A * 2/1890 Abraham ..... A61G 9/003 4/450
2,592,405 A 4/1952 Everest et al.
3,180,316 A * 4/1965 Chatfield ..... A01K 5/0291 119/51.12
3,271,785 A 9/1966 Du Bose
3,570,579 A * 3/1971 Matsushima ..... A47B 17/04 16/366
4,296,506 A 10/1981 Stoute, Sr. et al.
4,365,363 A 12/1982 Windauer
4,949,408 A 8/1990 Trkla
5,255,934 A 10/1993 Wilson
5,285,535 A 2/1994 Stewart et al.
5,608,925 A 3/1997 Porter
5,669,084 A * 9/1997 Sakimura ..... A47K 11/04 4/460
6,976,278 B2 12/2005 Oetting et al.
7,080,418 B2 * 7/2006 Henegar ..... A61G 7/02 280/250.1
D671,867 S * 12/2012 Mondotte ..... D12/133
2008/0290711 A1 * 11/2008 Fernie ..... A61G 5/1002 297/338
2009/0044326 A1 * 2/2009 Pettinga ..... A47K 11/06 4/484
2011/0277230 A1 * 11/2011 Williams ..... A61G 5/1002 4/480

* cited by examiner

*Primary Examiner* — Christine Skubinna
(74) *Attorney, Agent, or Firm* — Robert C. Montgomery; Montgomery Patent & Design

(57) ABSTRACT

A wheelchair has a platform assembly that includes a slide-out tray, a flexible cover, a toilet basin, and a storage pouch. The toilet basin is equipped with a waste liner and is capable of being removed from the slide-out tray. The bottom of the assembly has guide rails that enable the flexible cover to cover the toilet basin when it is inserted into the slide-out tray. The pouch, which is located on a front of the toilet seat can store supplies such as liners and deodorizers, as well as to conceal the toilet basin.

16 Claims, 6 Drawing Sheets

WHEELCHAIR WITH TOILET SEAT

RELATED APPLICATIONS

The present invention is a continuation-in-part of and claims the benefit of U.S. application Ser. No. 14/034,800, filed Sep. 24, 2013, the entire disclosures of which are incorporated herein by reference.

FIELD OF THE INVENTION

The presently disclosed subject matter is directed to wheelchairs. More particularly, it relates to wheelchairs that incorporate toilet facilities.

BACKGROUND OF THE INVENTION

Disabled and elderly people who are confined to wheelchairs are faced with major obstacles on a daily basis that most of us simply do not experience. What to most people is a simple act of going to the bathroom can be a major undertaking for those confined to wheelchairs as well as for their care providers.

In the past use was made of portable commodes to simplify the task of going to the bathroom by not requiring a wheelchair bound person to physically travel to a bathroom facility. However, the wheelchair bound person was still required to travel from their bed, chair, or wheelchair to use the portable commode. Often, especially in home care situations, there was insufficient physical space and often insufficient money for both a wheelchair and a portable commode. Very often the result was that additional travel and/or effort was required to reach a toilet facility.

The worry, stress, and embarrassment placed upon those restricted to wheelchairs and to their caregivers should not be underestimated. Accordingly, there exists a need for a means by which the functions of a wheelchair can be combined with that of a portable commode to serve the needs of the disabled or elderly, while reducing costs and saving space.

SUMMARY OF THE INVENTION

The principles of the present invention provide for wheelchairs having a toilet seat and toilet facilities.

A wheelchair with toilet seat that is in accord with the present invention includes a wheelchair having a seat area that is defined by seat frame members. A platform assembly is placed in the seat area. The platform assembly includes a frame, an "L"-shaped first channel attached to the bottom of the platform assembly and which extends longitudinally, an "L"-shaped second channel member that is attached to the bottom of the platform assembly and which extends longitudinally in parallel with the first channel, a first track attached to the bottom of the platform assembly, adjacent to the first channel, and which extends longitudinally, a second track that is attached to the bottom of the platform assembly, adjacent to the second channel, and which extends longitudinally in parallel with the first track, a platform aperture disposed through the frame between the first channel and the second channel, and a pair of wheelchair rests running longitudinally along either side of the bottom surface of the frame, adjacent to the first and second tracks.

The wheelchair further includes a slide-out tray having a basin receiver and a tray handle. The slide-out tray slides on the first track and on the second track. The slide-out tray is configured such that the basin receiver aligns with the platform aperture. A waste basin having a body is received in the basin receiver.

Beneficially, the waste basin is pear-shaped, the body has slopped walls, and there is a sealable liner enclosure in the waste basin to contain waste. To that end, the waste basin has a perimeter rim. The sealable liner enclosure fits into the waste basin and over the perimeter rim to be held in place.

Alternatively or in addition the wheelchair includes a pouch assembly that is attached to the front of the platform assembly. The pouch may be long enough to conceal the waste basin, it may be removable, and it may be used to store items. If so, the pouch may include a closure fastener. Another embodiment of the pouch assembly includes multiple pouches adjacent to each other, each having their own closure fastener.

The liner enclosure is preferably comprised of a flexible plastic liner body that is beneficially bio-degradable. The liner enclosure may include a pull cord closure along its top perimeter edge and/or a deodorizer might be added to the liner enclosure. In another embodiment, the liner has an absorbent pad affixed to an inner surface thereof.

In an exemplary embodiment, the pair of wheelchair rests are integrally-molded groves located on the bottom surface of the frame. Corresponding fasteners located in the wheelchair mate with fasteners located on the wheelchair frame members.

In practice, the straps are permanently affixed at one (1) end to the first frame by hardware fasteners and/or at the other end by hook-and-loop fasteners.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
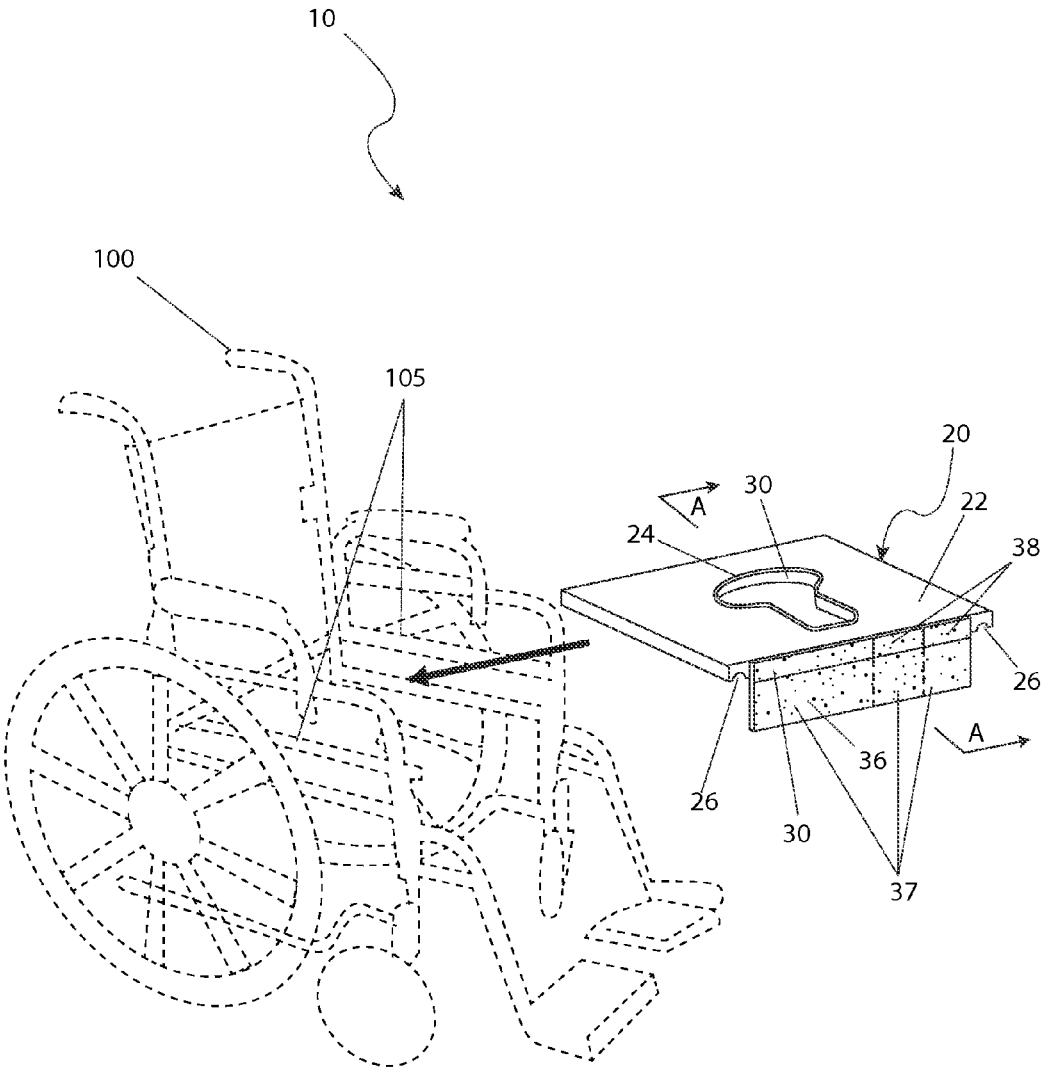
FIG. 1 is an environmental view of a wheelchair with toilet seat 10 according to a preferred embodiment of the present invention.

10 wheelchair with toilet seat
20 platform assembly
22 frame
24 platform aperture
26 wheelchair frame rest
30 waste basin
32 body

34 rim
36 pouch assembly
37 pocket
38 closure
39 storage space
40 liner enclosure
42 liner body
43 absorbent pad
44 cord
46 slide-out tray
47 tray handle
60 cover
61 cover stiffener
62 cover handle
64 cover track
65 curved portion
66 basin receiver
67 slide-out tray track
68 receiver cavity
70 hook-and-loop fastener
100 wheelchair
105 seat frame member
106 side walls
110 waste

DETAILED DESCRIPTION OF THE PREFERRED EMBODIMENT

The best mode for carrying out the invention is presented in terms of its preferred embodiment, herein is depicted in FIGS. 1 through 6*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one of the referenced items.

Referring to FIG. 1, the present invention is a wheelchair with toilet seat 10 that provides toilet facilities on a foldable wheelchair 100. The wheelchair with toilet seat 10 includes a platform assembly 20 that is placed upon and attached to side seat frame members 105 of the wheel chair 100. The platform assembly 20 includes a bottom-mounted slide-out tray 46 which supports a waste basin portion 30. A sealable removable liner 42 is placed in the waste basin 30 (reference FIGS. 6*a* and 6*b* and the discussion of those figures that follow) to catch waste 110. The wheelchair with toilet seat 10 allows the wheelchair 100 to serve as both a portable commode and a wheelchair.

Still referring primarily to FIG. 1, the wheelchair with toilet seat 10 is preferably implemented by retrofitting any of a variety of existing wheelchairs 100 having tubular type seat frame members 105. However, because of the added features provided by the principles of the present invention the wheelchair with toilet seat 100 can be implemented during fabrication of a wheelchair 100.

Figure 2:
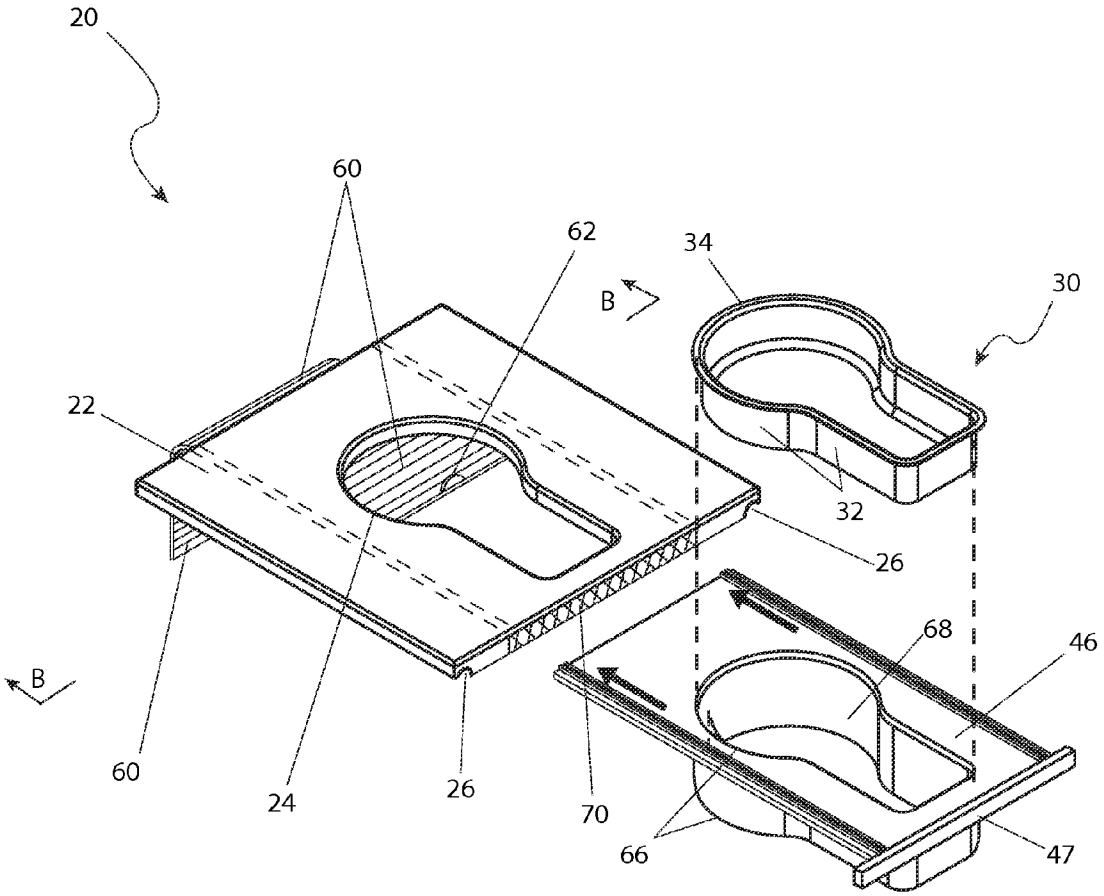
FIG. 2 is a perspective view of a platform assembly 20 used in the wheelchair with toilet seat 10 depicting an extended state shown in FIG. 1.

Referring now to both FIGS. 1 and 2, the wheelchair with toilet seat 10 includes a strong, rigid, and rectangular platform assembly 20 that is inserted onto the seat area of the wheelchair 100. The platform assembly 20 includes a frame 22 having half-cylinder-shaped wheelchair frame rests 26 along opposing side surfaces, allowing the platform assembly 20 to be positioned upon and supported by the side tubular seat frame members 105. The wheelchair frame rests 26 as well as the wheelchair seat frame members 105 receive corresponding adhesively affixed hook-and-loop fasteners 70 to provide a tight, secure attachment of the platform assembly 20 to the wheelchair 100.

Referring now to FIGS. 1 through 4, the wheelchair with toilet seat 10 also includes a removable and attachable textile pouch assembly 36. The pouch assembly 36 fastens to the forward edge of the platform assembly 20 and provides a means to store personal and related supplies. In addition, the pouch assembly 36 is envisioned to be segmented into a plurality of pockets 37 including respective closure flaps 38, also affixed using hook-and-loop fasteners 70. The pouch assembly 36 is long enough to conceal the presence of the waste basin 30 (reference in particular FIGS. 1 and 4).

Figure 3:
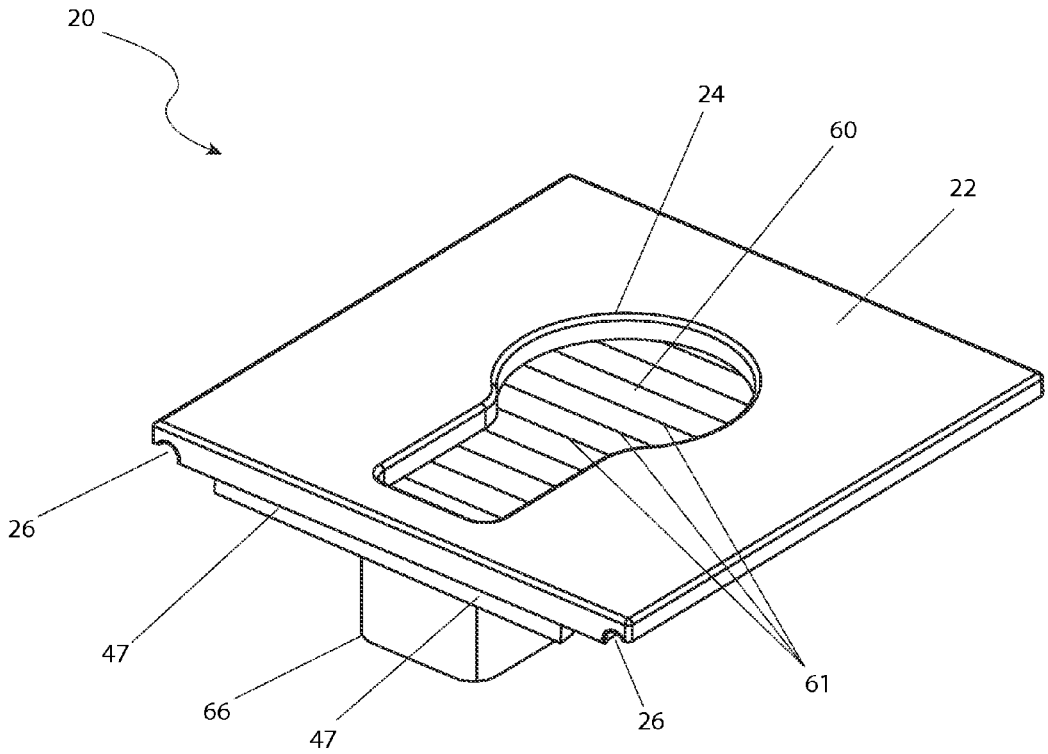
FIG. 3 is another perspective view of a platform assembly 20 used in the wheelchair with toilet seat 10 depicting a deployed cover portion 60.
Figure 4:
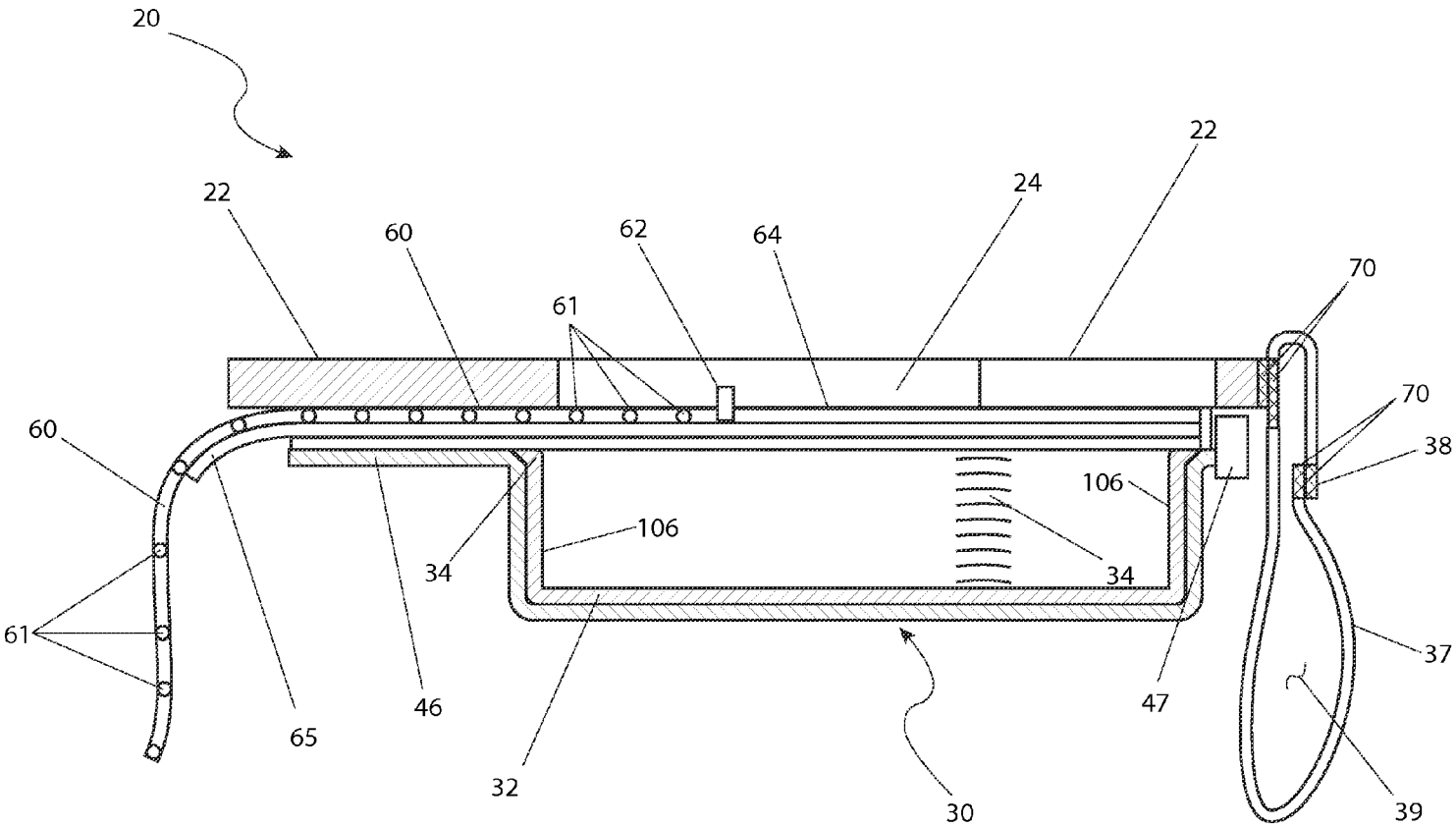
FIG. 4 is a sectional view of the platform assembly 20 taken along section line A-A of FIG. 1.
Figures 5A, 5B:
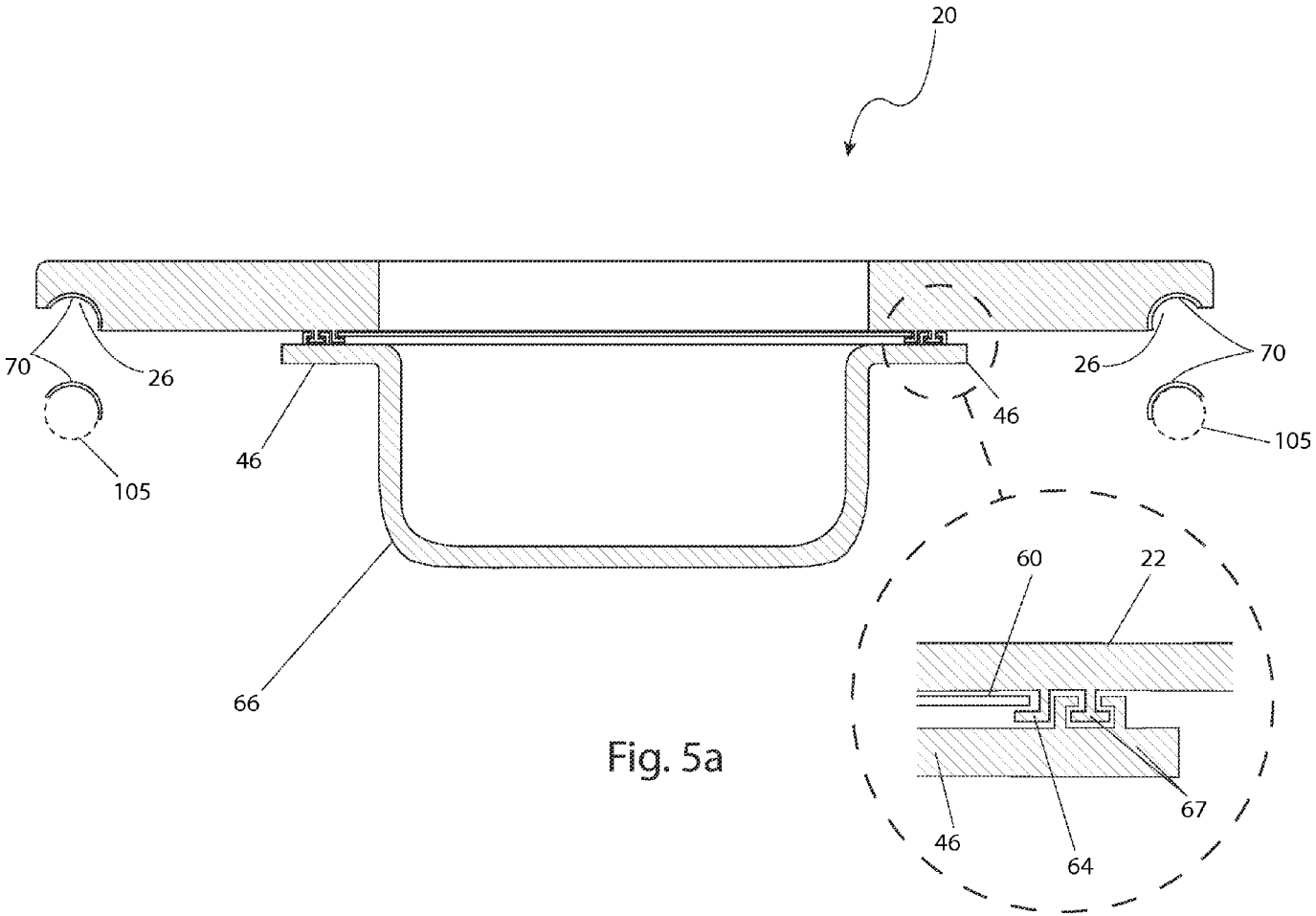
FIG. 5*a* is sectional view of the platform assembly 20 taken along section line B-B of FIG. 2.
FIG. 5*b* is a close-up view of track portions 46, 67 of the wheelchair with toilet seat 10 of FIG. 1.

Refer now to FIGS. 2 and 3 for perspective views of the platform assembly 20, and to FIGS. 4, 5*a*, and 5*b* for sectional views of the platform assembly 20 taken along section lines A-A and B-B (see FIGS. 1 and 2). The platform assembly 20 is shown in those figures with the pouch assembly 36 removed to provide a better explanatory illustration. The platform assembly 20 has a frame 22 that forms a flat panel. The frame 22 is envisioned to be made of rigid extruded or molded plastic or may be provided being made of wood. Furthermore, the frame 22 is envisioned being introduced in a variety of widths and lengths corresponding to seating areas of various wheelchairs 100.

As discussed above, the platform assembly 20 supports removable attachment to the wheelchair 100. The wheelchair frame rests 26 are integrally-molded along bottom surfaces along each side edge to form half-cylinder-shaped impressions. Furthermore the wheelchair frame rests 26 are to be partially or completely covered with an adhesively bonded hook-and-loop fastener material 70, allowing the frame portion 22 of the platform assembly 20 to be positioned and secured to correspondingly positioned hook-and-loop fastener portions 70 upon the side tubular seat frame members 105, thereby providing a removably attached connection of the platform assembly 20 to the wheelchair 100 (see FIG. 5*a*).

The frame portion 22 of the platform assembly 20 supports receiving and containing human waste 110 via a pear-shaped platform aperture 24 and a subjacent slidingly installed slide-out tray 46 which is designed to contain a waste basin 30. The slide-out tray 46 provides a planer surface being parallel to, and subjacent to the frame 22. The slide-out tray 46 is supported along side edges by opposing linear slide-out tray tracks 67 which enable a user to pull the slide-out tray 46 smoothly outward. The slide-out tray 46 includes a downwardly protruding and integrally-molded basin receiver 66 portion. The basin receiver 66 provides a form-fitting and nesting receiver cavity portion 68 providing snug insertion of the waste basin 30. In use, the waste basin 30 is snuggly inserted into the basin receiver 46 and the slide-out tray 46 is slid inwardly under the frame 22 resulting vertical alignment of the aforementioned platform aperture 24 and the waste basin 30 features. The waste basin 30 provides an upper rim portion 34 having a similar shape as the platform aperture 24, therefore receiving the waste 110 therein as it passes through the platform aperture 24.

The slide-out tray 46 is inserted into parallel "T"-shaped interlocking slide-out tray tracks 67 having interlocking features integrally-molded into respective frame 22 and slide-out tray 46 portions. The slide-out tray 46 further includes an integral linear tray handle 47 which extends across a forward edge portion for easy grasping and manipulation of the slide-out tray 46 as seen in FIG. 4.

The waste basin 30 beneficially has a pear-shaped body 32 having slightly tapering side walls 106 that extend to a horizontal perimeter rim 34. The slight tapering of the side walls 106 provides snug insertion of the waste basin 30 into the aforementioned basin receiver 66. The waste basin 30 provides improved support for the removable liners 42 that are inserted into the body 32 and under the rim 34. The waste basin 30 is envisioned as being made of a suitable plastic or stainless steel material to maintain sanitation, to be washable and reusable.

The platform assembly 20 also includes a flexible cover 60 which is supported between the frame 22 and the slide-out tray 46 on parallel "L"-shaped cover track portions 64 being adjacent to the previously described slide-out tray tracks 67. The cover 60 acts to effectively cover over and isolate odors within the waste basin 30 when necessary. The cover 60 is envisioned to comprise a plurality of parallel cover stiffeners 61 such as molded-in pleats, or other laterally strengthening features to enable rigid spanning between the cover tracks 64, being similar to a roll-top desk, while allowing single-axis downward deflection as it is extended outwardly from a rear portion of the platform assembly 20 via a curved portion 65 of the cover track 64 as seen in FIGS. 2 and 4. The cover 60 also includes an integral cover handle 62 which protrudes slightly upward into the platform aperture 24, providing a means to manually deploy or retract the cover 60 over the waste basin 30 as well as acting to mechanically limit the motioning of the cover 60.

Referring back to FIG. 3, the platform assembly 20 also supports the attachment of the pouch assembly 36. The pouch assembly 36 is attached and suspended along the front edge to the platform assembly 20 via corresponding linear strips of hook-and-loop fastener 70. The bottom of the pouch assembly 36 may be lifted, or the pouch assembly 36 may be completely removed if desired via detachment of the hook-and-loop fastener 70, to allow access to the slide-out tray 46 and subsequently to the waste basin 30 as needed. The pouch assembly 36 is further divided into a plurality of pockets 37 having individual closures 38 and internal storage spaces 39 which can be used to store personal items as well as items that are associated with the toilet function such as, but not limited to: waste containing liner enclosures 40, a deodorizer 90, toilet tissue, and the like. The pouch assembly 36 further enables concealment of the waste basin 30. The pouch assembly 36 storage spaces 39 extend across the front of the pouch assembly 36 and can be closed and attached by an elongated closure 38.

Figure 6B:
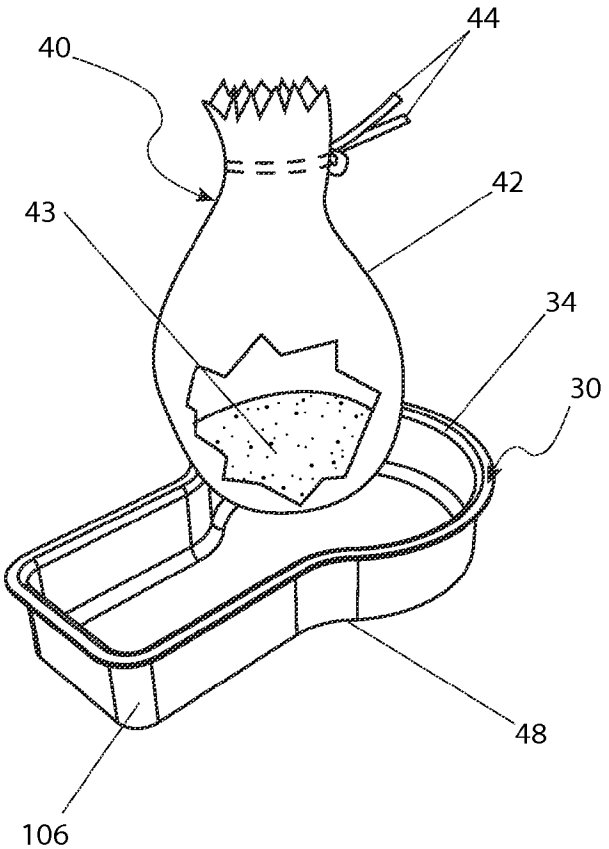
FIG. 6*a* is an isolated view of a waste basin 30 used in the wheelchair with toilet seat 10 depicting an in-use state; and, FIG. 6*b* is another isolated view of the waste basin 30 depicting another in-use state.
Figure 6A:
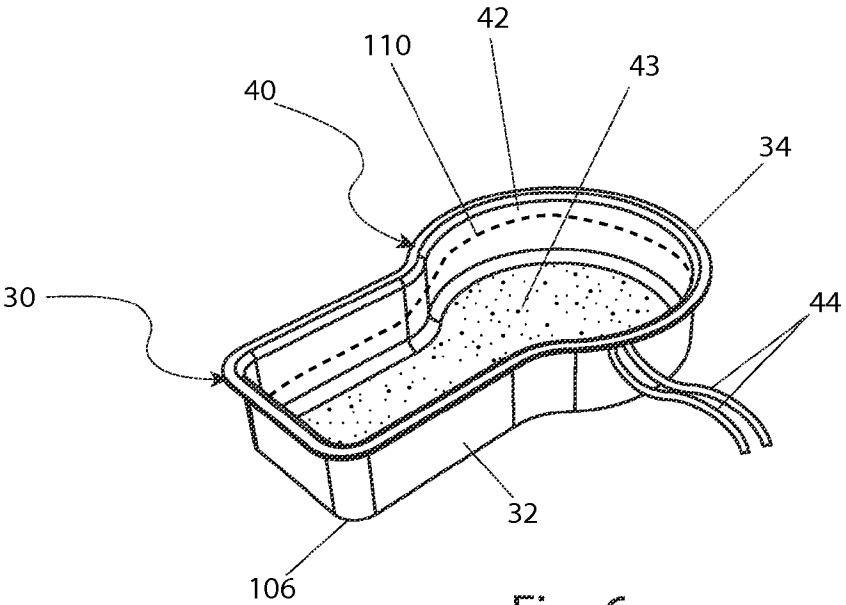

FIGS. 6*a* and 6*b* present isolated views of the waste basin 30 of the wheelchair with toilet seat 10 depicting in-use states. It is to be understood that the waste basin 30 may be removed from the slide-out tray 46, cleaned, rinsed, and reinstalled for repeated use. However, it is envisioned that the wheelchair with toilet seat 10 would be provided with additional sanitary means to enhance the disposal of the waste 110 including a quantity of plastic liner enclosures 40.

The liner enclosures 40 are envisioned as being a thin flexible plastic liner body 42 that are preferably made of a bio-degradable material and similar in shape to a common plastic bag. The liner enclosures 40 include a cord 44 along their top perimeter edge, such as a pull cord or the like for providing easy containment, removal, and disposal of waste 110. Each enclosure 40 is envisioned to provide an absorbent pad 43 being adhesively affixed to an internal bottom surface which acts to absorb and control fluids entering the enclosure 40.

It is envisioned that other styles and configurations of the present invention can be easily incorporated into the teachings of the present invention, and while only one particular configuration is shown and described that is for purposes of clarity and disclosure and not by way of limitation of scope.

The preferred embodiment of the present invention can be utilized by the common user in a simple and effortless manner with little or no training. After initial purchase or acquisition of the wheelchair with toilet seat 10, it would be installed as indicated in FIG. 1.

The method of installing and preparing the wheelchair with toilet seat 10 for use may be achieved by performing the following steps: procuring a model of the wheelchair with toilet seat 10 having an appropriately sized frame 22 which will fit within a seating area of an existing wheelchair 100; removing the seat of the existing wheelchair 100, if not previously removed; installing adhesive-backed portions of hook-and-loop fastener material 70 onto the wheelchair frame rest 26 and seat frame member portions 105 of the wheelchair 100; inserting the platform assembly 20 into the seating area of the wheelchair 100 so as to join the affixed hook-and-loop fasteners 70; installing the waste basin 30 into the basin receiver 66 portion of the slide-out tray 46; sliding the slide-out tray 46 along the slide-out tray track 67 of the platform assembly 20 installing the pouch assembly 36 upon a forward edge of the platform assembly 20 by attaching respective hook-and-loop fasteners 70; loading and storing personal items and toilet related supplies within the pocket portions 37 of the pouch assembly 36; and, securing the pouch assembly 36 in a closed state by fastening the hook-and-loop fastener portions 70 of each closure portion 38 of each pocket 37. The wheelchair with toilet seat 10 is now ready to provide mobile toilet functions when required.

Additional sanitary preparation may be performed if desired by inserting a liner enclosure 40 within the body 32 of the waste basin 30 and wrapping the top edge of the liner enclosure 40 around the rim 34 of said waste basin 30. The waste basin 30 is then placed into the basin receiver 66 of the slide-out tray 46, and the slide-out tray 46 is inserted along the slide-out tray tracks 67. After performing toilet duties, the wheelchair with toilet seat 10 may be temporarily restored by deploying the cover 60 over the waste basin 30 At a convenient time, the waste basin 30 may be removed by pulling the slide-out tray 46 outward along the slide-out tray tracks 67; the liner enclosure 40 being sealed shut using the cord 44; and the waste basin 30 removed from the basin receiver 66. The liner enclosure 40 and contained waste 110 are then removed from the waste basin 30 and disposed of in a suitable manner.

Once prepared as described above, the method of utilizing the wheelchair with toilet seat 10 may be achieved by performing the following steps: utilizing the wheelchair 100 equipped with the wheelchair with toilet seat 10 in a normal manner to transport a user; preparing the wheelchair with toilet seat 10 for toilet duties by retracting the cover 60, if deployed, using the cover handle 62; relieving one's self into the waste basin 30; utilizing the related items stored within the pouch assembly 36 to perform said toilet duties; deploying the cover 60 using the cover handle 62; disposing of the waste 110 within the waste basin 30 at a convenient time; detaching and removing the pouch assembly 36; sliding the slide-out tray 46 forwardly from between the user's legs and removing the waste basin 30 from the basin receiver 66;

disposing of the waste 110 and the liner enclosure 40, if so prepared, into a conventional toilet or other appropriate receptacle; cleaning and replacing the waste basin 30 into the basin receiver portion 66 of the slide-out tray 46; sliding said slide-out tray 46 into the slide-out tray tracks 67; and, reattaching the pouch assembly 36.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A wheelchair with toilet seat, comprising:

a wheelchair having a seat area defined by seat frame members;

a platform assembly in said seat area, said platform assembly having a frame, an "L"-shaped first channel attached to the bottom of said platform assembly that extends longitudinally along said bottom surface, an "L"-shaped second channel attached to the bottom of said platform assembly that extends longitudinally along said bottom surface and in parallel with said first channel, a first track attached to the bottom of said platform assembly, adjacent to said first channel, that extends longitudinally along said bottom surface, a second track attached to the bottom of said platform assembly, adjacent to said second channel, that extends longitudinally along said bottom surface parallel with said first track, a platform aperture disposed through said frame between said first channel and said second channel, a first wheelchair rest disposed longitudinally along a bottom surface adjacent to said first track, a second wheelchair rest disposed longitudinally along a bottom surface adjacent to said second track;

a slide-out tray having a downwardly protruding, integral basin receiver with an open top and a tray handle, said slide-out tray slidable on said first track and said second track, said slide-out tray configured such that said open top of said basin receiver aligns with said platform aperture when said slide-out tray is inserted within said platform assembly;

a flexible cover, movable along said first and second channels, and supported between said frame and said slide-out tray;

a pouch assembly removably attached to the front of said platform assembly; and, a waste basin having a body capable of being removably received in said basin receiver;

wherein said first and second wheelchair rests enable said platform assembly to securely abut said seat frame members such that said platform assembly rests thereon;

wherein said pouch assembly has a width coextensive with a width of said platform assembly, thereby enabling concealment of said waste basin when attached to said platform assembly; and, wherein said flexible cover selectively covers or uncovers said platform aperture.

2. The wheelchair according to claim 1, wherein said body has sloped walls.

3. The wheelchair according to claim 1, further including a sealable liner enclosure in said waste basin to contain waste.

4. The wheelchair according to claim 3, wherein said waste basin has a perimeter rim, and wherein said sealable liner enclosure fits into said waste basin and over said perimeter rim.

5. The wheelchair according to claim 1, wherein said pouch assembly further comprises a plurality of pockets, each comprising a closure means for selectively closing each of said plurality of pockets.

6. The wheelchair according to claim 1, wherein said flexible cover further comprises a plurality of parallel cover stiffeners and a cover handle on an upper surface thereof.

7. The wheelchair according to claim 6, wherein said cover handle protrudes through said platform aperture and provides a stop to longitudinal travel of said flexible cover relative to said first and second channels.

8. The wheelchair according to claim 3, wherein said liner enclosure is comprised of a flexible plastic liner body.

9. The wheelchair according to claim 8, wherein said liner enclosure further comprises an absorbent pad affixed to an internal surface thereof.

10. The wheelchair according to claim 8, wherein said liner body is bio-degradable.

11. The wheelchair according to claim 8, wherein said liner enclosure include a pull cord closure along its top perimeter edge.

12. The wheelchair according to claim 3, further including a deodorizer in said liner enclosure.

13. The wheelchair according to claim 1, wherein said first and second wheelchair rests are integrally molded half-cylinder shaped grooves.

14. The wheelchair according to claim 1, wherein said first and second wheelchair rests are integrally molded half-cylinder shaped grooves capable of being fastened to said seat frame members.

15. The wheelchair according to claim 1, wherein a perimeter of said waste basin is complementary with a perimeter of said basin receiver.

16. The wheelchair according to claim 15, wherein said waste basin is pear-shaped.

* * * * *